US007276657B2

(12) United States Patent
Bro et al.

(10) Patent No.: US 7,276,657 B2
(45) Date of Patent: Oct. 2, 2007

(54) MAXIMIZED SOUND PICKUP SWITCHING APPARATUS FOR A STRING INSTRUMENT HAVING A PLURALITY OF SOUND PICKUPS

(76) Inventors: William J. Bro, 3755 W. Cavalier Dr., Phoenix, AZ (US) 85019; Robert L. Super, 3735 W. Cavalier Dr., Phoenix, AZ (US) 85019

( * ) Notice: Subject to any disclaimer, the term of this patent is extended or adjusted under 35 U.S.C. 154(b) by 194 days.

(21) Appl. No.: 11/077,768

(22) Filed: Mar. 10, 2005

(65) Prior Publication Data

US 2005/0211081 A1 Sep. 29, 2005

Related U.S. Application Data

(60) Provisional application No. 60/553,448, filed on Mar. 15, 2004.

(51) Int. Cl.
*G10H 3/00* (2006.01)

(52) U.S. Cl. ..... 84/723; 84/730; 84/735

(58) Field of Classification Search ..... None
See application file for complete search history.

(56) References Cited

U.S. PATENT DOCUMENTS

| | | | | |
|---|---|---|---|---|
| 3,915,048 | A | | 10/1975 | Stich |
| 4,151,776 | A | | 5/1979 | Stich |
| 4,175,462 | A | | 11/1979 | Simon |
| 4,613,985 | A | | 9/1986 | Hashimoto |
| 4,711,149 | A | | 12/1987 | Starr |
| 4,733,591 | A | | 3/1988 | Kaneko |
| 4,773,294 | A | | 9/1988 | Iizuka |
| 5,136,919 | A | | 8/1992 | Wolstein |
| 5,299,282 | A | | 3/1994 | Tabei |
| 5,300,727 | A | | 4/1994 | Osuga |
| 5,311,806 | A | | 5/1994 | Riboloff |
| 5,343,793 | A | * | 9/1994 | Pattie ..... 84/454 |
| 5,380,948 | A | * | 1/1995 | Freimuth et al. ..... 84/8 |
| 5,399,800 | A | | 3/1995 | Morita |
| 5,738,080 | A | | 4/1998 | Brocco |
| 5,780,760 | A | | 7/1998 | Riboloff |
| 5,866,834 | A | * | 2/1999 | Burke et al. ..... 84/622 |
| 5,883,323 | A | * | 3/1999 | Kaufman ..... 84/454 |
| 6,316,713 | B1 | | 11/2001 | Furst |

* cited by examiner

*Primary Examiner*—Marlon Fletcher
(74) *Attorney, Agent, or Firm*—LaValle D. Ptak

(57) ABSTRACT

A sound pickup switching system for an electric string instrument which has at least two pickup coils and a multi-position selector switch, includes a switch matrix with a plurality of switches in it connected to the pickup coils. The switch matrix electrically interconnects the pickup coils in predetermined combinations of series, parallel, in-phase, or out-of-phase arrangements. A relay driver is coupled to the switch matrix to operate the switches under control of outputs from a table memory coupled with the relay driver. User input controls are coupled with the table memory for entering and storing groups of user selected switch combinations in the table memory; and connections are made between the selector switch on the string instrument and the table memory for enabling the table memory to cause the relay driver to operate predetermined combinations of switches in the switch matrix corresponding to different positions of the selector switch on the electric string instrument.

18 Claims, 7 Drawing Sheets

MAXIMIZED SOUND PICKUP SWITCHING APPARATUS FOR A STRING INSTRUMENT HAVING A PLURALITY OF SOUND PICKUPS

RELATED APPLICATION

This patent application is based on, and claims the benefit of priority under Title 35 U.S.C. §119(e) of co-pending provisional application Ser. No. 60/553,448 filed on Mar. 15, 2004, incorporated herein by reference.

BACKGROUND

Electric stringed instruments, such as electric guitars have a number of sound pickups (coils). Such instruments also typically include a multiple-position switch, such as a three-way or five-way switch, to select coil settings or interconnections for changing the tonality of the instrument. In addition, such electric stringed instruments generally also have a volume control and a tonal control potentiometer which work in conjunction with the multiple-position switch to produce the desired output from the instrument. It is desirable to provide a system to provide the operator/musician a maximum number of coil settings and overall control of the capabilities of the stringed instrument.

DETAILED DESCRIPTION

Sound pickups for stringed instruments, in particular for electric guitars, normally have either one coil or else a so-called "double coil", which has two electrically separate coils arranged on the sound pickup. Such a double coil also is called a "humbucker" pickup.

On electric guitars, a plurality of sound pickups normally are arranged spaced-apart in the direction in which the strings run. Well known arrangements include the "GIBSON®" tonality, which comprises two sound pickups with a double coil, and the "FENDER®" tonality, which comprises three sound pickups, each having one coil. In addition, other arrangement variations of sound pickups are known, for example an arrangement in which a further sound pickup with one coil is arranged between two sound pickups each having a double coil, and which detects the oscillations of the strings.

Figure 1:
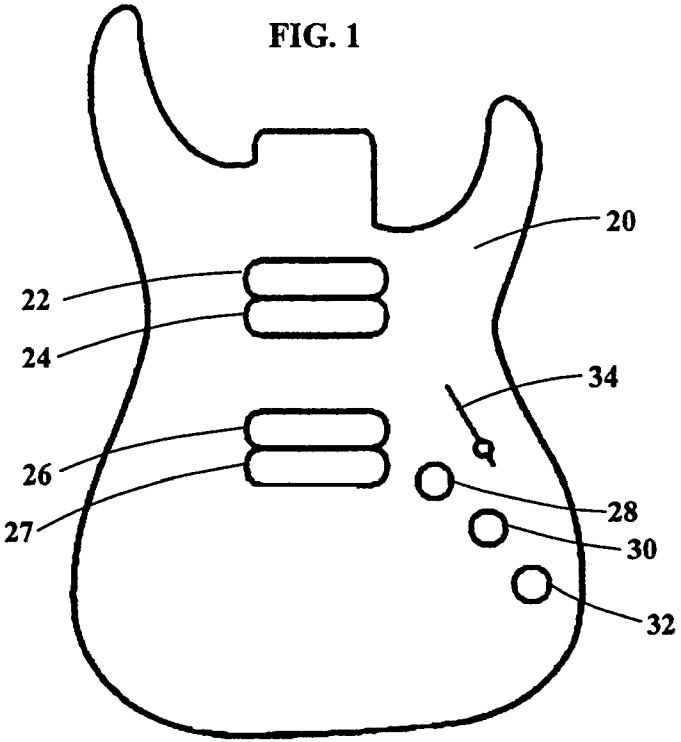
FIG. 1 is a front view of a four coil guitar used in conjunction with the invention.
Figure 3:
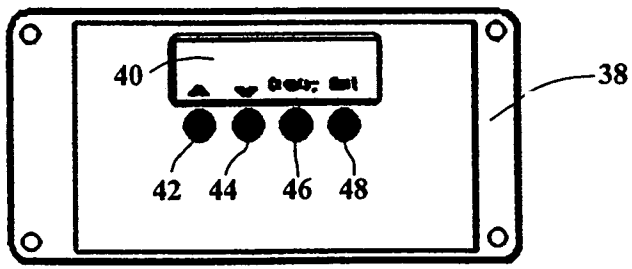
FIG. 3 is an enlarged view of a control module shown in FIG. 2.

FIG. 1 shows a front of a typical guitar 20 (with the neck and strings removed for clarity), which includes two typical pairs of sound pickups illustrated as neck coils 22 and 24, and bridge coils 26 and 27. As illustrated in FIG. 1, a pair of volume control rotatable switches 28 and 30 are shown for operating volume control potentiometers, as described subsequently. A further tone/optional control 32 is also shown in a substantially standard location on the front of the guitar. A slide switch 34, which typically is a three-position or a five-position slide switch, also is located on the guitar 20, and is movable to any of the three or five different switch positions.

The positions of the switch 34 connect the coils of the sound pickups 22,24,26 and 27 in different combinations in order to produce different output signals of different tonality. In a standard guitar, the number of combinations which can be achieved (series, parallel, in-phase, or out-of-phase) is limited by the wiring of the coils selected through the five-position switch. Modifications of the factory preset values can be made; but only a limited number of combinations typically are possible. They are not quickly and easily changed.

In the embodiment of the invention which is shown in the drawings, a switching matrix operated by an electronic micro-controller 38 (such as Microchip part No. PICI8F452) allows the user to maximize the number of coil options. Each of the many possible coil combinations (series, parallel, in-phase or out-of-phase) is achieved by the switching matrix in a manner which allows the user to maximize the available preset combination options for the coils of the sound pickups. The maximized switching apparatus of the embodiment which is disclosed is designed as a mechanical switch, which maximizes the available preset combination options for the coils of the sound pickups. The maximized switching apparatus is designed to select one of the programmable preset connections. An individual coil, or a combination of coils are connected in series, in parallel, in-phase or out-of-phase. The signal from the coils connected in such a manner is passed to a downstream electro-acoustic transducer, in particular an amplifier and loudspeaker (not shown, since these are standard).

The micro-controller 38 controls a relay driver circuit 54 (FIG. 4), which controls switch settings in a relay switch matrix 56. The switches of the matrix 56 are designed to be electro-mechanical, for example comprising an electromagnetic relay in the driver module 54 and a make contact in the matrix 56 to make physical contact to reduce the on state resistance which has a detrimental effect on the tonality of the sound produced by the instrument.

Figure 5:
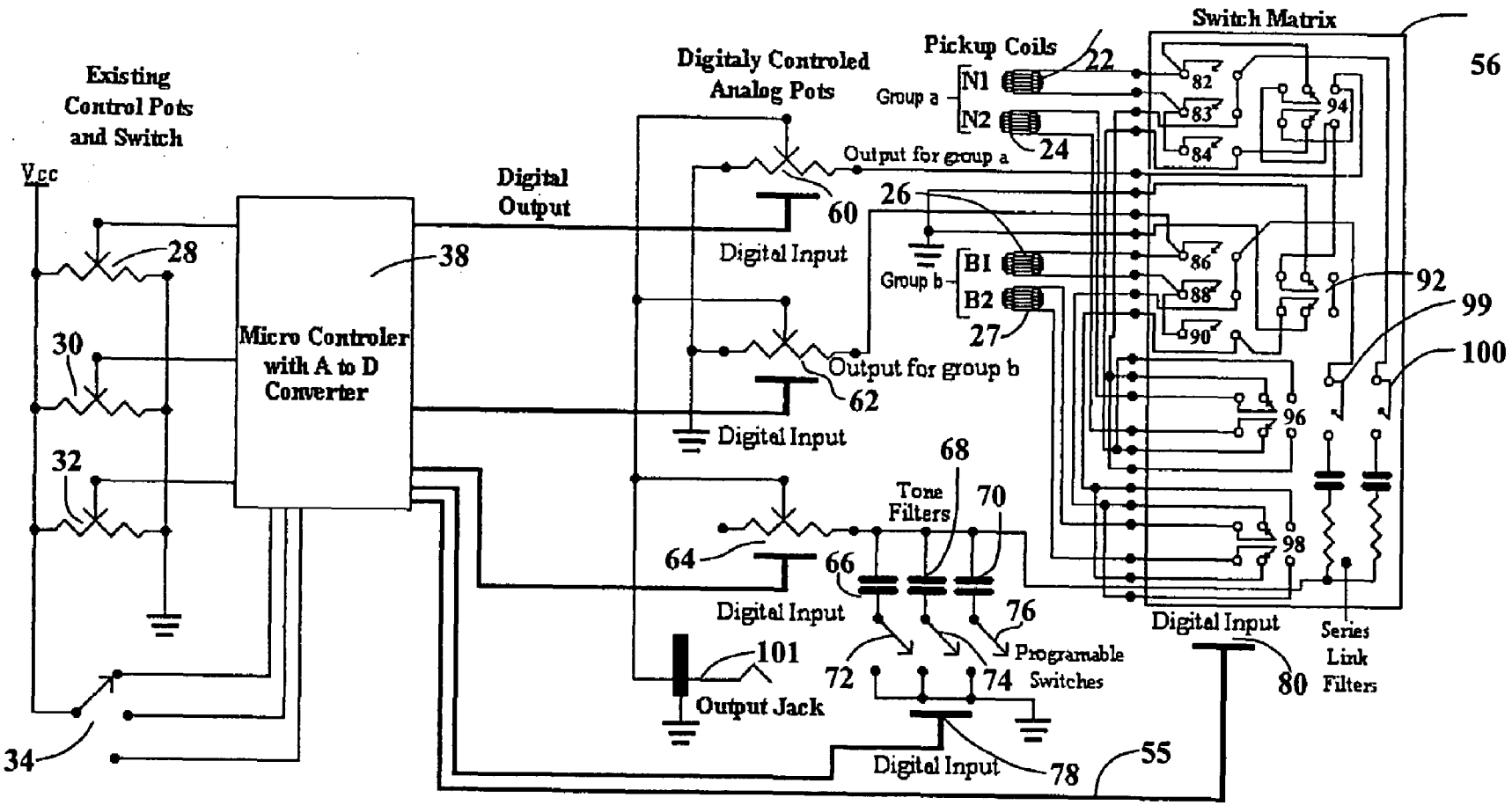
FIG. 5 is a detailed schematic diagram of an embodiment of the invention.

Unlike mechanical switches of the type shown in the embodiment illustrated in greater detail in FIG. 5, transistor switches alter the overall impedance of the selected coil combinations, affecting the tonality. Solid state or transistor switches could be used, provided they have an "on" resistance characteristic equal to that of mechanical switches. This, however, is not always attained.

Figure 4:
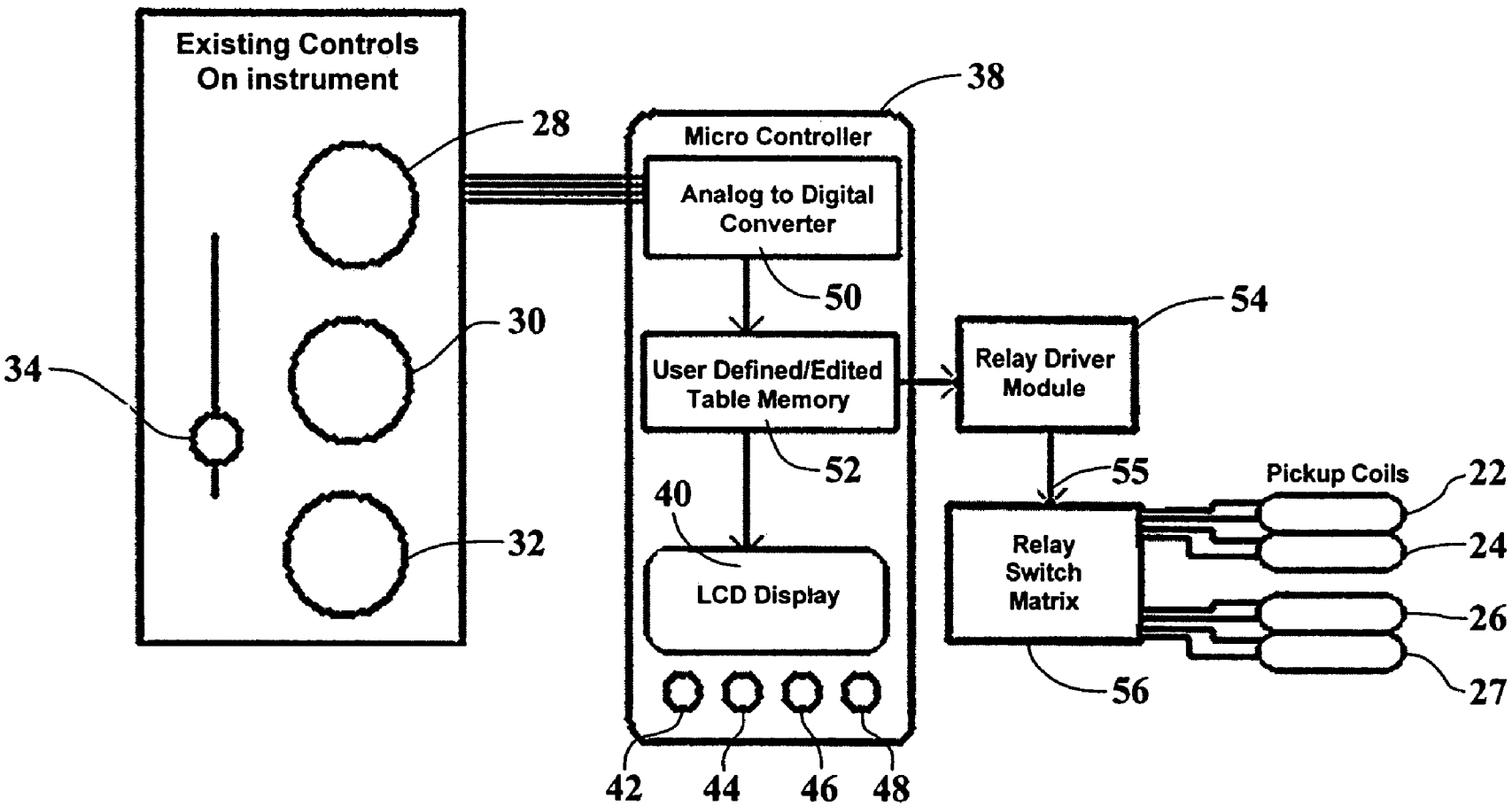
FIG. 4 is a block diagram of an embodiment of the invention.

In the embodiment which is illustrated, the drive apparatus for the relay switch matrix 56 is designed to be programmable and in addition, includes a memory to store combinations of coils selected by the user. Reference should be made to FIG. 4, which illustrates the overall system employed by the preferred embodiment. The existing controls on the instrument, consisting of the illustrated volume control potentiometer knobs 28 and 30 and the tone potentiometer knob 32, as well as the three or five position switch 34, supply outputs to the micro-controller 38. The micro-controller 38 in turn has an analog-to-digital converter 50 in it for converting these inputs to a digital form. These signals are supplied to a table memory 52, along with inputs from a user-selected table displayed on an LCD display 40 in the micro-controller 38.

The micro-controller 38 includes programs for all of the different possible coil combinations, with any combination of any two to six coils-on the instrument. The example which is shown in the illustrated embodiment is a four-coil electric guitar. It should be noted that the system shown in FIG. 4, however, is designed to be a universal controller which may be used in any stringed instrument using the existing pickups and controls of that instrument.

The different possible combinations are stored in the memory 52 and are selected by operating a display button 46 to display them on the LCD display 40. The various combinations may be scrolled up by the push-button 42 or down by the push-button 44 in a manner well known to computer users. The push-button 48 is used to edit any of the selected inputs which are chosen by the position of the switch 34 on the instrument. For example, if the instrument has three positions, each of those positions can be correlated with a particular combination, as selected and displayed on the LCD display 40. When the combination desired by the user is found, the icon in the display is selected, and is stored in the table memory 52, to associate the selected position of the switch 34 with the selected display. The system then operates the relay driver module in the switch matrix 56 to interconnect the pickup coils 22,24,26 and 27 in the manner selected. The volume and tone control settings present at the time of selection of the pickup coil interconnections also are stored in the user-defined table memory 52.

Once the desired combinations have been stored and associated with each of the different positions of the switch 34 on the instrument, the user can access the selected pickup combinations simply by using the existing controls 28,30,32 and 34 on the instrument. Whenever the user desires to change the output sound by interconnecting the pickup coils 22,24,26, and 27 in some other manner, the micro-controller 38 can be operated through the buttons 42,44,46 and 48 until the desired combination is displayed on the LCD display 40. Once it is displayed, it then can be stored by the user in the memory 52 to associate that combination with the selected position of the switch 34 on the instrument.

The selected tonality can be listened to directly by operating the strings of the instrument in the normal manner. If the selected tonality does not have the sound desired by the user, the existing volume and tone controls 28,30 and 32 also can be used to alter the state of the programmed potentiometers associated with these control functions. This gives the user additional flexibility in fine tuning the overall sound of the selected combination. This sound combination, including the volume and tone controls, is stored to a user-defined location associated with the position of the switch 34, and may be quickly recalled by way of the selected switch setting of the switch 34. This is explained in greater detail in conjunction with FIG. 5.

Figure 2:
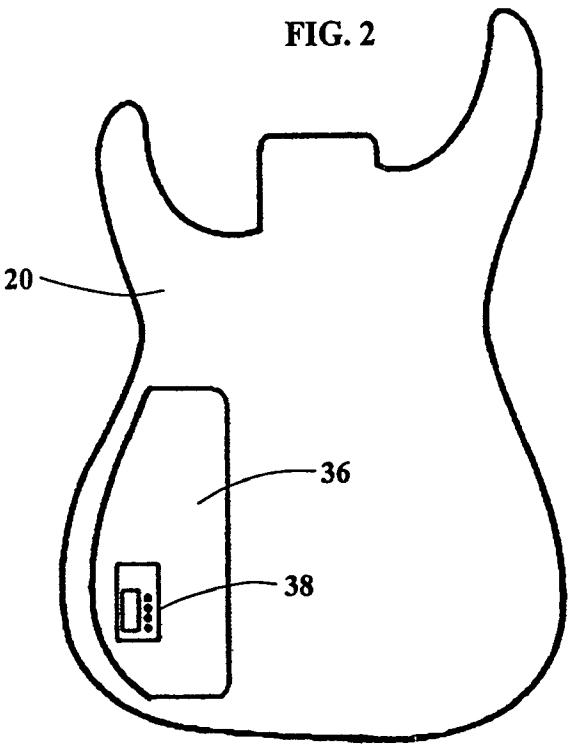
FIG. 2 is a rear view of the guitar of FIG. 1 showing the location of an element of the invention.

FIG. 5 is an overall circuit diagram of an embodiment of the invention used in conjunction with a four-coil guitar of the type shown in FIGS. 1 and 2. As shown in FIG. 5, the existing control potentiometers and switches associated with the volume control potentiometers 28 and 30 and the tone control potentiometer 32 are shown in the left-hand side of FIG. 5. These are the standard potentiometer controls associated with the guitar. The multiple position slide switch 34 is shown at the bottom left of FIG. 5 as a three-position switch. All of these controls are presently available on a typical four-coil electric guitar. As mentioned above in conjunction with FIG. 4, all of these inputs are supplied to the micro-controller 38. The analog-to-digital converter 50 in the controller 38 supplies digital outputs corresponding to the settings of the controls on the front of the guitar. As illustrated in FIG. 5, the volume control digital outputs 60 and 62 correspond to the volume control settings of the control potentiometers 28 and 30 of the guitar.

A tone control digital output 64 corresponds to the setting of the tone control potentiometer 32 on the guitar. These digital controls from the micro-controller 38 then are transformed to analog signals by the digitally controlled analog pots 60,62 and 64, which typically may be an Analog Devices part AD5255.

The output of the tone control analog potentiometer 64 may further be supplied to a tone filter consisting of three different parallel capacitors 66,68 and 70 (which may be of the same or different values) connected, selectively, by programmable switches 72,74 and 76 by means of a digital input controller 78, as established by the micro-controller 38. The digital input controller 78 for the switches 72,74 and 76 may be provided by an Analog Devices part ADG715.

As shown in FIG. 5, the relay switch matrix 56 is shown in detail as controlled by a digital input 80 from the micro-controller 38. The digital input 80 operates through the relay driver module 54 (such as Maxim Semiconductor MAX 4820) to selectively operate relays for operating switches in the switch matrix, namely switches 82,83,84, 86,88, 90,92,94,96,98,99 and 100. In order to avoid unnecessary cluttering of the drawing, the relay coils which are provided with signals to operate these switches are not shown, since the manner of operating relay coils to close or open switches is well known. The switches themselves have been shown in order to illustrate all of the different combinations of interconnections which can be made of the neck pickup coils 22 and 24 and the bridge pickup coils 26 and 27 on the guitar shown in FIG. 1. As shown in FIG. 5, the volume setting from the digitally controlled analog potentiometer 60 controls the volume for the neck pickup coils 22 and 24, whereas the setting for the digitally controlled analog potentiometer 62 controls the volume for the bridge pickup coils 26 and 27.

If there are two coils, the electrical combinations which yield different tonalities are:

1. Coil A alone
2. Coil B alone
3. Coil A in series with Coil B in-phase
4. Coil A in series with Coil B out-of-phase
5. Coil A in parallel with Coil B in-phase
6. Coil A in parallel with Coil B out-of-phase
7. Coil A and Coil B off.

It should be noted that redundant coils combinations, such as Coil B in series with Coil A which produce the same tonality as Coil A in series with Coil B, have been omitted.

Figure 6:
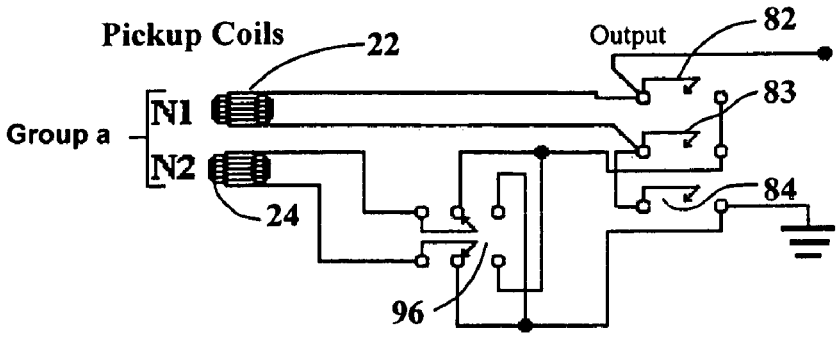
FIGS. 6 through 10 each are enlarged portions of the embodiment shown in FIG. 5 useful in explaining the operation of the embodiment shown in FIG. 5.

The switch matrix 56 can accomplish all of these musical combinations with a pair of coils using the following switch combinations. Reference should be made to FIG. 6, which illustrates the portion of the switch matrix 56 associated with the two neck coils 22 and 24. As shown in FIG. 6, the neck pickup coils 22 and 24 are connected in various combinations by means of the switches 82,83,84 and 98. The seven combinations are achieved as follows:

1. Coil 22 alone—switch 84 is closed to complete a path to ground.

2. Coil 24 alone—switch 82 is closed to complete a path to output jack.

3. Coil 22 in series with Coil 24 in-phase—switch 83 is closed to link 22 and 24 in series, switch 98 is deactivated (position shown) to put 22 and 24 in-phase.

4. Coil 22 in series with Coil 24 out-of-phase—switch 83 is closed to link 22 and 24 in series; switch 98 is operated (to right-hand contacts) to put 22 and 24 out-of-phase.

5. Coil 22 in parallel with Coil 24 in-phase—switches 82 and 84 are closed and switch 98 is deactivated to put 22 and 24 in-phase.

6. Coil 22 in parallel with Coil 24 out-of-phase—switches 82 and 84 are closed; and switch 98 is activated to put 22 and 24 out-of-phase.

7. Coil 22 and Coil 24 off—switches 82,83,84 are open and switch 98 is deactivated to the position shown in FIG. 6.

Figure 7:
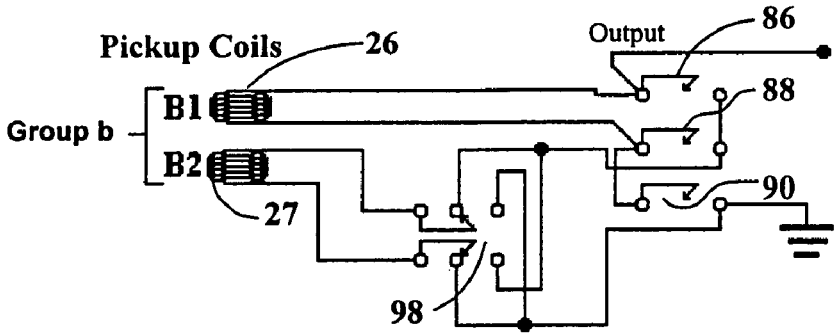

A similar operation is achieved for the bridge pickup coils 26 and 27, with the portion associated with these coils in the switch matrix 56 of FIG. 5 illustrated in enlarged detail in FIG. 7. The seven combinations possible for the pickup coils 26 and 27 as shown in FIG. 7, are as follows:

1. Coil 26 alone—switch 90 is closed to complete path to ground.

2. Coil 27 alone—switch 86 is closed to complete a path to the output jack.

3. Coil 26 in series with Coil 27 in-phase—switch 88 is closed to link 26 and 27 in series, switch 98 is deactivated (the position shown in FIG. 7) to put coils 26 and 27 in-phase.

4. Coil 26 in series with Coil 27 out-of-phase—switch 88 is closed to link 26 and 27 in series; switch 98 is activated to put 26 and 27 out-of-phase.

5. Coil 26 in parallel with Coil 27 in-phase—switches 86 and 90 are closed; and switch 98 is deactivated (as shown) to put 26 and 27 in-phase.

6. Coil 26 in parallel with Coil 27 out-of-phase—switches 86 and 90 are closed; and switch 98 is activated to connect Coils 26 and 27 out-of-phase.

7. Coil 26 and Coil 27 off—switches 86,88 and 90 are open and switch 98 is deactivated (position shown in FIG. 7).

Figure 8:
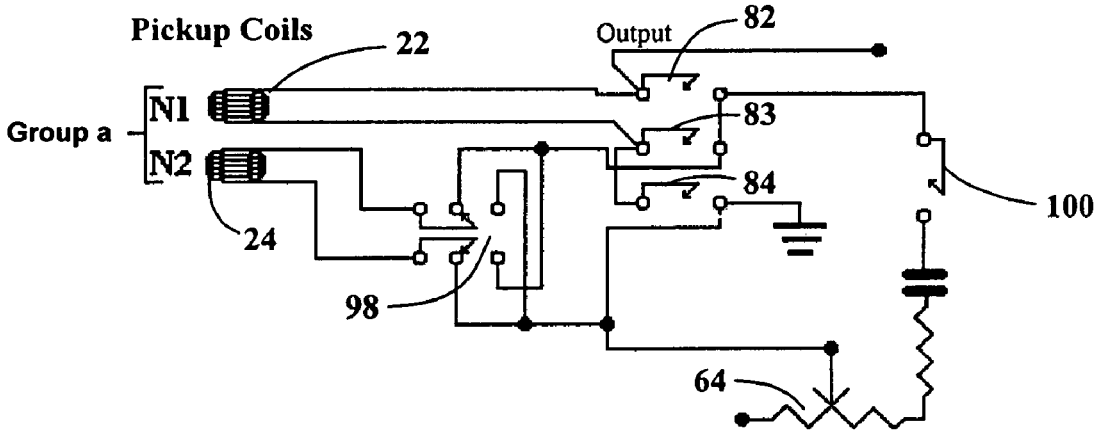

In addition to the various interconnections of the coils which have been described above in conjunction with FIGS. 6 and 7, the switch matrix 56 also includes the ability to filter the second coil of each group by applying a series link filter consisting of a capacitor and resistor in series with the tone potentiometer 64. This is shown in enlarged detail in FIG. 8. The example which is given is for the neck pickup coils 22 and 24; but a similar ability is also provided for the bridge pickup coils 26 and 27.

With respect to the pickup coils 22 and 24, the switch matrix which has been shown above and described in detail in conjunction with FIG. 6 is further illustrated with an interconnection from the switch 83 through a series connected switch 100, and a capacitor-resistor in series with the potentiometer 64. With the switch 83 closed (coils 22 and 24 on in-series) closing the switch 100 applies the filter to the coil 24 by linking to ground through the potentiometer 64 and the series link capacitor and resistor illustrated. An identical filter configuration also is provided for the coils 26 and 27 using the switch 99 (FIG. 5). With the switch 88 closed and the switches 99 and 100 open, this additional link filter feature is not applied.

Figure 9:
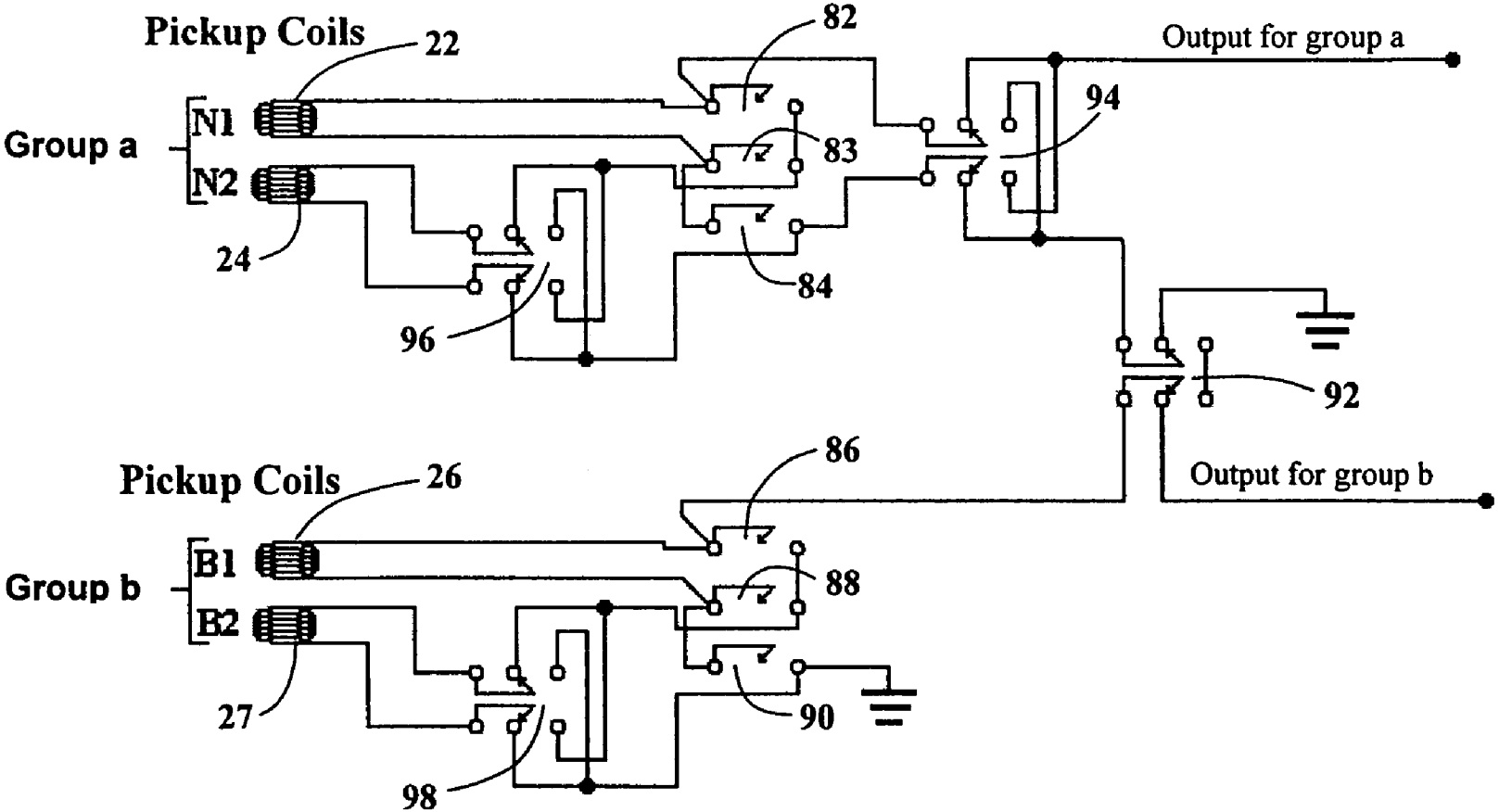

The four coil switch matrix which has been described above in conjunction primarily with FIGS. 5,6 and 7 also may be used to arrange the two groups of coils, namely the neck pickup coils 22 and 24 and the bridge pickup coils 26 and 27, in any combination of series or parallel, in or out of phase, with the switch combinations shown in the detail of FIG. 9, as follows:

1. Group A consisting of the pickup coils 22 and 24 alone—switches 82,83,84 and 96 configured as shown and described in conjunction with FIG. 6 above, and the explanation there with switches 86,88 and 90 open; switches 92 and 94 deactivated to the position shown in FIG. 9.

2. Group B, pickup coils 26 and 27 alone—switches 86,88, 90 and 98 configured as shown and described above in conjunction with FIG. 7 and the explanation in conjunction therewith, with switches 82,83 and 84 open; switches 92 and 94 deactivated (to the position shown in FIG. 9).

3. Coils 22 and 24 in parallel with Coils 26 and 27 in-phase—switches 82,83 and 84, switches 1 and 3 are closed; switches 86 and 90 are closed; and switches 92 and 94 are deactivated (to the position shown in FIG. 9).

4. Coils 22 and/or 24 in series with Coils 26 and/or 27 in-phase; switch 92 activated and switch 94 deactivated (to the default position shown in FIG. 9).

5. Coils 22 and/or 24 in series with Coils 26 and/or 27 out-of-phase; switches 92 and 94 activated to the right hand position.

6. Coils 22 and/or 24 in parallel with Coils 26 and/or 27 out-of-phase; switch 92 deactivated (to the position shown in FIG. 9) and switch 94 activated to the right hand position shown in FIG. 9.

7. Pickup coils 22,24,26 and 27 off-switches 82,83,84,86, 88,90,96 and 98 all off or deactivated to the default position shown in FIG. 9.

Figure 10:
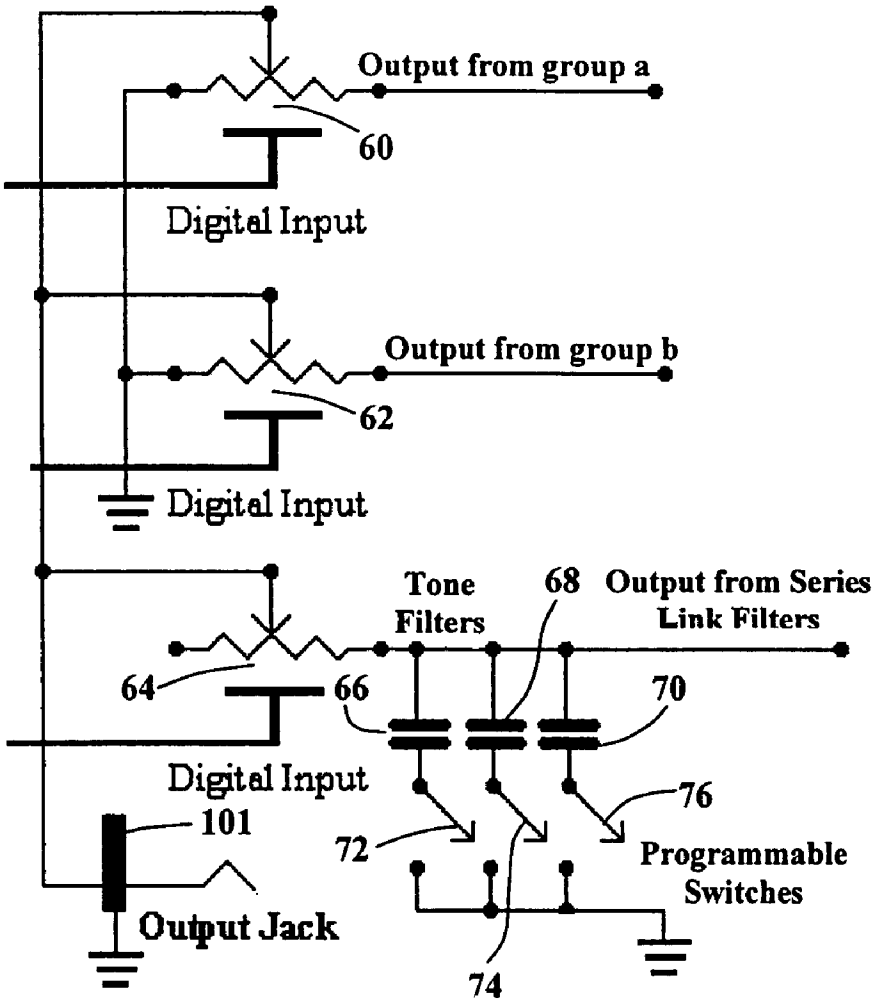

As mentioned above, the system shown in FIG. 5 also has the ability to control the volume of each pickup individually, as well as the overall tone of the group(s) selected. This is shown in FIG. 10, which is an enlargement of the same portion of the overall circuit diagram of FIG. 5. The following applies to FIG. 10:

1. The volume of the neck pickup coils 22 and 24 is controlled by adjusting the digitally controlled analog potentiometer 60.

2. The volume of the bridge coils 26 and 27 is controlled by adjusting the digitally controlled analog potentiometer 62.

3. The tone of either the neck pickup coils 22,24 or the bridge coils 26,27 is controlled by closing the switches 72,74 or 76. Closing each of these three switches individually or in different combinations provides different filter values by putting the capacitors 66,68 and 70 in parallel with one another. The amount of the filtering is controlled by adjusting the digitally controlled analog potentiometer 64.

As shown in both FIG. 5 and the enlarged portion of FIG. 10, the output for the guitar which is supplied to the amplifiers and loudspeakers (not shown), is obtained from the output jack 101 in a conventional manner.

All of the 158 tonalities which are possible with the four-coil guitar system described above in conjunction with FIGS. 1 through 9 can be achieved with this system. The pickup coil combination table for these tonalities, all of which can be achieved by the various settings of the ten switches 82,83,84,86,88,90,92,94,96 and 98 described above, can be achieved as shown in the following pickup combination table.

TABLE 1

| Coil Combo | Hum Cancel | Neck Pickup | Bridge Pickup | N + B Series/Parallel | N + B Phase | 1 1 | 2 2 | 3 4 | 4 8 | 5 16 | 6 32 | 7 64 | 8 128 | 9 | 10 |
|---|---|---|---|---|---|---|---|---|---|---|---|---|---|---|---|
| 0 | X | Off | Off | x | x | 0 | 0 | 0 | 0 | 0 | 0 | 0 | 0 | 0 | 0 |
| 1 | N | Off | 1 | x | x | 0 | 0 | 0 | 0 | 0 | 1 | 0 | 0 | 0 | 0 |
| 2 | N | Off | 2 | x | x | 1 | 0 | 0 | 1 | 0 | 0 | 0 | 0 | 0 | 0 |
| 3 | Y | Off | 1 + 2 Series-I | x | x | 0 | 0 | 0 | 0 | 1 | 0 | 0 | 0 | 0 | 0 |
| 4 | Y | Off | 1 + 2 Parallel-I | x | x | 0 | 0 | 0 | 1 | 0 | 1 | 0 | 0 | 0 | 0 |
| 5 | N | Off | 1 + 2 Parallel-O | x | x | 0 | 0 | 0 | 1 | 0 | 1 | 0 | 0 | 0 | 1 |
| 6 | N | Off | 1 + 2 Series-O | x | x | 0 | 0 | 0 | 0 | 1 | 0 | 0 | 0 | 0 | 1 |
| 7 | N | 1 | Off | x | x | 0 | 0 | 1 | 0 | 0 | 0 | 0 | 0 | 0 | 0 |
| 8 | N | 2 | Off | x | x | 1 | 0 | 0 | 0 | 0 | 0 | 0 | 0 | 0 | 0 |
| 9 | Y | 1 + 2 Series-I | Off | x | x | 0 | 1 | 0 | 0 | 0 | 0 | 0 | 0 | 0 | 0 |
| 10 | Y | 1 + 2 Parallel-I | Off | x | x | 1 | 0 | 1 | 0 | 0 | 0 | 0 | 0 | 0 | 0 |
| 11 | Y | 1 + 2 Series-O | Off | x | x | 0 | 1 | 0 | 0 | 0 | 0 | 0 | 0 | 1 | 0 |
| 12 | Y | 1 + 2 Parallel-O | Off | x | x | 1 | 0 | 1 | 0 | 0 | 0 | 0 | 0 | 1 | 0 |
| 13 | N | 1 | 1 | Parallel | In Phase | 0 | 0 | 1 | 0 | 0 | 1 | 0 | 0 | 0 | 0 |
| 14 | N | 1 | 1 | Series | In Phase | 0 | 0 | 1 | 0 | 0 | 1 | 1 | 0 | 0 | 0 |
| 15 | Y | 1 | 1 | Parallel | Out of Phase | 0 | 0 | 1 | 0 | 0 | 1 | 0 | 1 | 0 | 0 |
| 16 | Y | 1 | 1 | Series | Out of Phase | 0 | 0 | 1 | 0 | 0 | 1 | 1 | 1 | 0 | 0 |
| 17 | Y | 2 | 1 | Parallel | In Phase | 1 | 0 | 0 | 0 | 0 | 1 | 0 | 0 | 0 | 0 |
| 18 | Y | 2 | 1 | Series | In Phase | 1 | 0 | 0 | 0 | 0 | 1 | 1 | 0 | 0 | 0 |
| 19 | N | 2 | 1 | Parallel | Out of Phase | 1 | 0 | 0 | 0 | 0 | 1 | 0 | 1 | 0 | 0 |
| 20 | N | 2 | 1 | Series | Out of Phase | 1 | 0 | 0 | 0 | 0 | 1 | 1 | 1 | 0 | 0 |
| 21 | Y | 1 | 2 | Parallel | In Phase | 0 | 0 | 1 | 1 | 0 | 0 | 0 | 0 | 0 | 0 |
| 22 | Y | 1 | 2 | Series | In Phase | 0 | 0 | 1 | 1 | 0 | 0 | 1 | 0 | 0 | 0 |
| 23 | N | 1 | 2 | Parallel | Out of Phase | 0 | 0 | 1 | 1 | 0 | 0 | 0 | 1 | 0 | 0 |
| 24 | N | 1 | 2 | Series | Out of Phase | 0 | 0 | 1 | 1 | 0 | 0 | 1 | 1 | 0 | 0 |
| 25 | N | 2 | 2 | Parallel | In Phase | 1 | 0 | 0 | 1 | 0 | 0 | 0 | 0 | 0 | 0 |
| 26 | N | 2 | 2 | Series | In Phase | 1 | 0 | 0 | 1 | 0 | 0 | 1 | 0 | 0 | 0 |
| 27 | Y | 2 | 2 | Parallel | Out of Phase | 1 | 0 | 0 | 1 | 0 | 0 | 0 | 1 | 0 | 0 |
| 28 | Y | 2 | 2 | Series | Out of Phase | 1 | 0 | 0 | 1 | 0 | 0 | 1 | 1 | 0 | 0 |
| 29 | Y | 1 + 2 Series-I | 1 + 2 Series-I | Parallel | In Phase | 0 | 1 | 0 | 0 | 1 | 0 | 0 | 0 | 0 | 0 |
| 30 | Y | 1 + 2 Series-I | 1 + 2 Series-I | Series | In Phase | 0 | 1 | 0 | 0 | 1 | 0 | 1 | 0 | 0 | 0 |
| 31 | Y | 1 + 2 Series-I | 1 + 2 Series-I | Parallel | Out of Phase | 0 | 1 | 0 | 0 | 1 | 0 | 0 | 1 | 0 | 0 |
| 32 | Y | 1 + 2 Series-I | 1 + 2 Series-I | Series | Out of Phase | 0 | 1 | 0 | 0 | 1 | 0 | 1 | 1 | 0 | 0 |
| 33 | Y | 1 + 2 Series-I | 1 + 2 Series-I | Parallel | In Phase | 1 | 0 | 1 | 0 | 1 | 0 | 0 | 0 | 0 | 0 |
| 34 | Y | 1 + 2 Series-I | 1 + 2 Series-I | Series | In Phase | 1 | 0 | 1 | 0 | 1 | 0 | 1 | 0 | 0 | 0 |
| 35 | Y | 1 + 2 Series-I | 1 + 2 Series-I | Parallel | Out of Phase | 1 | 0 | 1 | 0 | 1 | 0 | 0 | 1 | 0 | 0 |
| 36 | Y | 1 + 2 Series-I | 1 + 2 Series-I | Series | Out of Phase | 1 | 0 | 1 | 0 | 1 | 0 | 1 | 1 | 0 | 0 |
| 37 | N | 1 + 2 Series-I | 1 + 2 Series-O | Parallel | In Phase | 0 | 1 | 0 | 0 | 1 | 0 | 0 | 0 | 0 | 1 |
| 38 | N | 1 + 2 Series-I | 1 + 2 Series-O | Series | In Phase | 0 | 1 | 0 | 0 | 1 | 0 | 1 | 0 | 0 | 1 |
| 39 | N | 1 + 2 Series-I | 1 + 2 Series-O | Parallel | Out of Phase | 0 | 1 | 0 | 0 | 1 | 0 | 0 | 1 | 0 | 1 |
| 40 | N | 1 + 2 Series-I | 1 + 2 Series-O | Series | Out of Phase | 0 | 1 | 0 | 0 | 1 | 0 | 1 | 1 | 0 | 1 |
| 41 | N | 1 + 2 Series-I | 1 + 2 Series-O | Parallel | In Phase | 1 | 0 | 1 | 0 | 1 | 0 | 0 | 0 | 0 | 1 |
| 42 | N | 1 + 2 Series-I | 1 + 2 Series-O | Series | In Phase | 1 | 0 | 1 | 0 | 1 | 0 | 1 | 0 | 0 | 1 |
| 43 | N | 1 + 2 Series-I | 1 + 2 Series-O | Parallel | Out of Phase | 1 | 0 | 1 | 0 | 1 | 0 | 0 | 1 | 0 | 1 |
| 44 | N | 1 + 2 Series-I | 1 + 2 Series-O | Series | Out of Phase | 1 | 0 | 1 | 0 | 1 | 0 | 1 | 1 | 0 | 1 |
| 45 | N | 1 + 2 Series-O | 1 + 2 Series-I | Parallel | In Phase | 0 | 1 | 0 | 0 | 1 | 0 | 0 | 0 | 1 | 0 |
| 46 | N | 1 + 2 Series-O | 1 + 2 Series-I | Series | In Phase | 0 | 1 | 0 | 0 | 1 | 0 | 1 | 0 | 1 | 0 |
| 47 | N | 1 + 2 Series-O | 1 + 2 Series-I | Parallel | Out of Phase | 0 | 1 | 0 | 0 | 1 | 0 | 0 | 1 | 1 | 0 |
| 48 | N | 1 + 2 Series-O | 1 + 2 Series-I | Series | Out of Phase | 0 | 1 | 0 | 0 | 1 | 0 | 1 | 1 | 1 | 0 |
| 49 | N | 1 + 2 Series-O | 1 + 2 Series-I | Parallel | In Phase | 1 | 0 | 1 | 0 | 1 | 0 | 0 | 0 | 1 | 0 |
| 50 | N | 1 + 2 Series-O | 1 + 2 Series-I | Series | In Phase | 1 | 0 | 1 | 0 | 1 | 0 | 1 | 0 | 1 | 0 |
| 51 | N | 1 + 2 Series-O | 1 + 2 Series-I | Parallel | Out of Phase | 1 | 0 | 1 | 0 | 1 | 0 | 0 | 1 | 1 | 0 |
| 52 | N | 1 + 2 Series-O | 1 + 2 Series-I | Series | Out of Phase | 1 | 0 | 1 | 0 | 1 | 0 | 1 | 1 | 1 | 0 |
| 53 | Y | 1 + 2 Series-O | 1 + 2 Series-O | Parallel | In Phase | 0 | 1 | 0 | 0 | 1 | 0 | 0 | 0 | 1 | 1 |
| 54 | Y | 1 + 2 Series-O | 1 + 2 Series-O | Series | In Phase | 0 | 1 | 0 | 0 | 1 | 0 | 1 | 0 | 1 | 1 |
| 55 | Y | 1 + 2 Series-O | 1 + 2 Series-O | Parallel | Out of Phase | 0 | 1 | 0 | 0 | 1 | 0 | 0 | 1 | 1 | 1 |
| 56 | Y | 1 + 2 Series-O | 1 + 2 Series-O | Series | Out of Phase | 0 | 1 | 0 | 0 | 1 | 0 | 1 | 1 | 1 | 1 |
| 57 | Y | 1 + 2 Series-O | 1 + 2 Series-O | Parallel | In Phase | 1 | 0 | 1 | 0 | 1 | 0 | 0 | 0 | 1 | 1 |
| 58 | Y | 1 + 2 Series-O | 1 + 2 Series-O | Series | In Phase | 1 | 0 | 1 | 0 | 1 | 0 | 1 | 0 | 1 | 1 |
| 59 | Y | 1 + 2 Series-O | 1 + 2 Series-O | Parallel | Out of Phase | 1 | 0 | 1 | 0 | 1 | 0 | 0 | 1 | 1 | 1 |
| 60 | Y | 1 + 2 Series-O | 1 + 2 Series-O | Series | Out of Phase | 1 | 0 | 1 | 0 | 1 | 0 | 1 | 1 | 1 | 1 |
| 61 | Y | 1 + 2 Series-I | 1 + 2 Parallel-I | Parallel | In Phase | 0 | 1 | 0 | 1 | 0 | 1 | 0 | 0 | 0 | 0 |
| 62 | Y | 1 + 2 Series-I | 1 + 2 Parallel-I | Series | In Phase | 0 | 1 | 0 | 1 | 0 | 1 | 1 | 0 | 0 | 0 |
| 63 | Y | 1 + 2 Series-I | 1 + 2 Parallel-I | Parallel | Out of Phase | 0 | 1 | 0 | 1 | 0 | 1 | 0 | 1 | 0 | 0 |
| 64 | Y | 1 + 2 Series-I | 1 + 2 Parallel-I | Series | Out of Phase | 0 | 1 | 0 | 1 | 0 | 1 | 1 | 1 | 0 | 0 |
| 65 | Y | 1 + 2 Parallel-I | 1 + 2 Parallel-I | Parallel | In Phase | 1 | 0 | 1 | 1 | 0 | 1 | 0 | 0 | 0 | 0 |
| 66 | Y | 1 + 2 Parallel-I | 1 + 2 Parallel-I | Series | In Phase | 1 | 0 | 1 | 1 | 0 | 1 | 1 | 0 | 0 | 0 |
| 67 | Y | 1 + 2 Parallel-I | 1 + 2 Parallel-I | Parallel | Out of Phase | 1 | 0 | 1 | 1 | 0 | 1 | 0 | 1 | 0 | 0 |
| 68 | Y | 1 + 2 Parallel-I | 1 + 2 Parallel-I | Series | Out of Phase | 1 | 0 | 1 | 1 | 0 | 1 | 1 | 1 | 0 | 0 |
| 69 | N | 1 + 2 Series-I | 1 + 2 Parallel-O | Parallel | In Phase | 0 | 1 | 0 | 1 | 0 | 1 | 0 | 0 | 0 | 1 |
| 70 | N | 1 + 2 Series-I | 1 + 2 Parallel-O | Series | In Phase | 0 | 1 | 0 | 1 | 0 | 1 | 1 | 0 | 0 | 1 |
| 71 | N | 1 + 2 Series-I | 1 + 2 Parallel-O | Parallel | Out of Phase | 0 | 1 | 0 | 1 | 0 | 1 | 0 | 1 | 0 | 1 |
| 72 | N | 1 + 2 Series-I | 1 + 2 Parallel-O | Series | Out of Phase | 0 | 1 | 0 | 1 | 0 | 1 | 1 | 1 | 0 | 1 |
| 73 | N | 1 + 2 Parallel-I | 1 + 2 Parallel-O | Parallel | In Phase | 1 | 0 | 1 | 1 | 0 | 1 | 0 | 0 | 0 | 1 |
| 74 | N | 1 + 2 Parallel-I | 1 + 2 Parallel-O | Series | In Phase | 1 | 0 | 1 | 1 | 0 | 1 | 1 | 0 | 0 | 1 |
| 75 | N | 1 + 2 Parallel-I | 1 + 2 Parallel-O | Parallel | Out of Phase | 1 | 0 | 1 | 1 | 0 | 1 | 0 | 1 | 0 | 1 |

TABLE 1-continued

| Coil Combo | Hum Cancel | Neck Pickup | Bridge Pickup | N + B Series/Parallel | N + B Phase | 1 1 | 2 2 | 3 4 | 4 8 | 5 16 | 6 32 | 7 64 | 8 128 | 9 | 10 |
|---|---|---|---|---|---|---|---|---|---|---|---|---|---|---|---|
| 76 | N | 1 + 2 Parallel-I | 1 + 2 Parallel-O | Series | Out of Phase | 1 | 0 | 1 | 1 | 0 | 1 | 1 | 1 | 0 | 1 |
| 77 | Y | 1 + 2 Series-O | 1 + 2 Parallel-I | Parallel | In Phase | 0 | 1 | 0 | 1 | 0 | 1 | 0 | 0 | 1 | 0 |
| 78 | Y | 1 + 2 Series-O | 1 + 2 Parallel-I | Series | In Phase | 0 | 1 | 0 | 1 | 0 | 1 | 1 | 0 | 1 | 0 |
| 79 | Y | 1 + 2 Series-O | 1 + 2 Parallel-I | Parallel | Out of Phase | 0 | 1 | 0 | 1 | 0 | 1 | 0 | 1 | 1 | 0 |
| 80 | Y | 1 + 2 Series-O | 1 + 2 Parallel-I | Series | Out of Phase | 0 | 1 | 0 | 1 | 0 | 1 | 1 | 1 | 1 | 0 |
| 81 | Y | 1 + 2 Parallel-O | 1 + 2 Parallel-I | Parallel | In Phase | 1 | 0 | 1 | 1 | 0 | 1 | 0 | 0 | 1 | 0 |
| 82 | Y | 1 + 2 Parallel-O | 1 + 2 Parallel-I | Series | In Phase | 1 | 0 | 1 | 1 | 0 | 1 | 1 | 0 | 1 | 0 |
| 83 | Y | 1 + 2 Parallel-O | 1 + 2 Parallel-I | Parallel | Out of Phase | 1 | 0 | 1 | 1 | 0 | 1 | 0 | 1 | 1 | 0 |
| 84 | Y | 1 + 2 Parallel-O | 1 + 2 Parallel-I | Series | Out of Phase | 1 | 0 | 1 | 1 | 0 | 1 | 1 | 1 | 1 | 0 |
| 85 | Y | 1 + 2 Series-O | 1 + 2 Parallel-O | Parallel | In Phase | 0 | 1 | 0 | 1 | 0 | 1 | 0 | 0 | 1 | 1 |
| 86 | Y | 1 + 2 Series-O | 1 + 2 Parallel-O | Series | In Phase | 0 | 1 | 0 | 1 | 0 | 1 | 1 | 0 | 1 | 1 |
| 87 | Y | 1 + 2 Series-O | 1 + 2 Parallel-O | Parallel | Out of Phase | 0 | 1 | 0 | 1 | 0 | 1 | 0 | 1 | 1 | 1 |
| 88 | Y | 1 + 2 Series-O | 1 + 2 Parallel-O | Series | Out of Phase | 0 | 1 | 0 | 1 | 0 | 1 | 1 | 1 | 1 | 1 |
| 89 | Y | 1 + 2 Parallel-O | 1 + 2 Parallel-O | Parallel | In Phase | 1 | 0 | 1 | 1 | 0 | 1 | 0 | 0 | 1 | 1 |
| 90 | Y | 1 + 2 Parallel-O | 1 + 2 Parallel-O | Series | In Phase | 1 | 0 | 1 | 1 | 0 | 1 | 1 | 0 | 1 | 1 |
| 91 | Y | 1 + 2 Parallel-O | 1 + 2 Parallel-O | Parallel | Out of Phase | 1 | 0 | 1 | 1 | 0 | 1 | 0 | 1 | 1 | 1 |
| 92 | Y | 1 + 2 Parallel-O | 1 + 2 Parallel-O | Series | Out of Phase | 1 | 0 | 1 | 1 | 0 | 1 | 1 | 1 | 1 | 1 |
| 93 | N | 1 + 2 Series-I | 1 | Parallel | In Phase | 0 | 1 | 0 | 0 | 0 | 1 | 0 | 0 | 0 | 0 |
| 94 | N | 1 + 2 Series-I | 1 | Series | In Phase | 0 | 1 | 0 | 0 | 0 | 1 | 1 | 0 | 0 | 0 |
| 95 | N | 1 + 2 Series-I | 1 | Parallel | Out of Phase | 0 | 1 | 0 | 0 | 0 | 1 | 0 | 1 | 0 | 0 |
| 96 | N | 1 + 2 Series-I | 1 | Series | Out of Phase | 0 | 1 | 0 | 0 | 0 | 1 | 1 | 1 | 0 | 0 |
| 97 | N | 1 + 2 Parallel-I | 1 | Parallel | In Phase | 1 | 0 | 1 | 0 | 0 | 1 | 0 | 0 | 0 | 0 |
| 98 | N | 1 + 2 Parallel-I | 1 | Series | In Phase | 1 | 0 | 1 | 0 | 0 | 1 | 1 | 0 | 0 | 0 |
| 99 | N | 1 + 2 Parallel-I | 1 | Parallel | Out of Phase | 1 | 0 | 1 | 0 | 0 | 1 | 0 | 1 | 0 | 0 |
| 100 | N | 1 + 2 Parallel-I | 1 | Series | Out of Phase | 1 | 0 | 1 | 0 | 0 | 1 | 1 | 1 | 0 | 0 |
| 101 | N | 1 + 2 Series-I | 2 | Parallel | In Phase | 0 | 1 | 0 | 1 | 0 | 0 | 0 | 0 | 0 | 0 |
| 102 | N | 1 + 2 Series-I | 2 | Series | In Phase | 0 | 1 | 0 | 1 | 0 | 0 | 1 | 0 | 0 | 0 |
| 103 | N | 1 + 2 Series-I | 2 | Parallel | Out of Phase | 0 | 1 | 0 | 1 | 0 | 0 | 0 | 1 | 0 | 0 |
| 104 | N | 1 + 2 Series-I | 2 | Series | Out of Phase | 0 | 1 | 0 | 1 | 0 | 0 | 1 | 1 | 0 | 0 |
| 105 | N | 1 + 2 Parallel-I | 2 | Parallel | In Phase | 1 | 0 | 1 | 1 | 0 | 0 | 0 | 0 | 0 | 0 |
| 106 | N | 1 + 2 Parallel-I | 2 | Series | In Phase | 1 | 0 | 1 | 1 | 0 | 0 | 1 | 0 | 0 | 0 |
| 107 | N | 1 + 2 Parallel-I | 2 | Parallel | Out of Phase | 1 | 0 | 1 | 1 | 0 | 0 | 0 | 1 | 0 | 0 |
| 108 | N | 1 + 2 Parallel-I | 2 | Series | Out of Phase | 1 | 0 | 1 | 1 | 0 | 0 | 1 | 1 | 0 | 0 |
| 109 | N | 1 + 2 Series-O | 1 | Parallel | In Phase | 0 | 1 | 0 | 0 | 0 | 1 | 0 | 0 | 1 | 0 |
| 110 | N | 1 + 2 Series-O | 1 | Series | In Phase | 0 | 1 | 0 | 0 | 0 | 1 | 1 | 0 | 1 | 0 |
| 111 | N | 1 + 2 Series-O | 1 | Parallel | Out of Phase | 0 | 1 | 0 | 0 | 0 | 1 | 0 | 1 | 1 | 0 |
| 112 | N | 1 + 2 Series-O | 1 | Series | Out of Phase | 0 | 1 | 0 | 0 | 0 | 1 | 1 | 1 | 1 | 0 |
| 113 | N | 1 + 2 Parallel-O | 1 | Parallel | In Phase | 1 | 0 | 1 | 0 | 0 | 1 | 0 | 0 | 1 | 0 |
| 114 | N | 1 + 2 Parallel-O | 1 | Series | In Phase | 1 | 0 | 1 | 0 | 0 | 1 | 1 | 0 | 0 | 0 |
| 115 | N | 1 + 2 Parallel-O | 1 | Parallel | Out of Phase | 1 | 0 | 1 | 0 | 0 | 1 | 0 | 1 | 1 | 0 |
| 116 | N | 1 + 2 Parallel-O | 1 | Series | Out of Phase | 1 | 0 | 1 | 0 | 0 | 1 | 1 | 1 | 1 | 0 |
| 117 | N | 1 + 2 Series-O | 2 | Parallel | In Phase | 0 | 1 | 0 | 1 | 0 | 0 | 0 | 0 | 1 | 0 |
| 118 | N | 1 + 2 Series-O | 2 | Series | In Phase | 0 | 1 | 0 | 1 | 0 | 0 | 1 | 0 | 1 | 0 |
| 119 | N | 1 + 2 Series-O | 2 | Parallel | Out of Phase | 0 | 1 | 0 | 1 | 0 | 0 | 0 | 1 | 1 | 0 |
| 120 | N | 1 + 2 Series-O | 2 | Series | Out of Phase | 0 | 1 | 0 | 1 | 0 | 0 | 1 | 1 | 1 | 0 |
| 121 | N | 1 + 2 Parallel-O | 2 | Parallel | In Phase | 1 | 0 | 1 | 1 | 0 | 0 | 0 | 0 | 1 | 0 |
| 122 | N | 1 + 2 Parallel-O | 2 | Series | In Phase | 1 | 0 | 1 | 1 | 0 | 0 | 1 | 0 | 1 | 0 |
| 123 | N | 1 + 2 Parallel-O | 2 | Parallel | Out of Phase | 1 | 0 | 1 | 1 | 0 | 0 | 0 | 1 | 1 | 0 |
| 124 | N | 1 + 2 Parallel-O | 2 | Series | Out of Phase | 1 | 0 | 1 | 1 | 0 | 0 | 1 | 1 | 1 | 0 |
| 125 | N | 1 | 1 + 2 Series-I | Parallel | In Phase | 0 | 0 | 1 | 0 | 1 | 0 | 0 | 0 | 0 | 0 |
| 126 | N | 1 | 1 + 2 Series-I | Parallel | Out of Phase | 0 | 0 | 1 | 0 | 1 | 0 | 0 | 1 | 0 | 0 |
| 127 | N | 1 | 1 + 2 Series-I | Series | In Phase | 0 | 0 | 1 | 0 | 1 | 0 | 1 | 0 | 0 | 0 |
| 128 | N | 1 | 1 + 2 Series-I | Series | Out of Phase | 0 | 0 | 1 | 1 | 0 | 1 | 1 | 1 | 0 | 0 |
| 129 | N | 1 | 1 + 2 Parallel-I | Parallel | In Phase | 0 | 0 | 1 | 1 | 0 | 1 | 0 | 0 | 0 | 0 |
| 130 | N | 1 | 1 + 2 Parallel-I | Parallel | Out of Phase | 0 | 0 | 1 | 1 | 0 | 1 | 0 | 1 | 0 | 0 |
| 131 | N | 1 | 1 + 2 Parallel-I | Series | In Phase | 0 | 0 | 1 | 1 | 0 | 1 | 1 | 0 | 0 | 0 |
| 132 | N | 1 | 1 + 2 Parallel-I | Series | Out of Phase | 0 | 0 | 1 | 1 | 0 | 1 | 1 | 1 | 0 | 0 |
| 133 | N | 2 | 1 + 2 Series-I | Parallel | In Phase | 1 | 0 | 0 | 1 | 0 | 1 | 0 | 0 | 0 | 0 |
| 134 | N | 2 | 1 + 2 Series-I | Parallel | Out of Phase | 1 | 0 | 0 | 1 | 0 | 1 | 0 | 1 | 0 | 0 |
| 135 | N | 2 | 1 + 2 Series-I | Series | In Phase | 1 | 0 | 0 | 1 | 0 | 1 | 1 | 0 | 0 | 0 |
| 136 | N | 2 | 1 + 2 Series-I | Series | Out of Phase | 1 | 0 | 0 | 1 | 0 | 1 | 1 | 1 | 0 | 0 |
| 137 | N | 2 | 1 + 2 Parallel-I | Parallel | In Phase | 1 | 0 | 0 | 1 | 0 | 1 | 0 | 0 | 0 | 0 |
| 138 | N | 2 | 1 + 2 Parallel-I | Parallel | Out of Phase | 1 | 0 | 0 | 1 | 0 | 1 | 0 | 1 | 0 | 0 |
| 139 | N | 2 | 1 + 2 Parallel-I | Series | In Phase | 1 | 0 | 0 | 1 | 0 | 1 | 1 | 0 | 0 | 0 |
| 140 | N | 2 | 1 + 2 Parallel-I | Series | Out of Phase | 1 | 0 | 0 | 1 | 0 | 1 | 1 | 1 | 0 | 0 |
| 141 | N | 1 | 1 + 2 Series-O | Parallel | In Phase | 0 | 0 | 1 | 0 | 1 | 0 | 0 | 0 | 0 | 1 |
| 142 | N | 1 | 1 + 2 Series-O | Parallel | Out of Phase | 0 | 0 | 1 | 0 | 1 | 0 | 0 | 1 | 0 | 1 |
| 143 | N | 1 | 1 + 2 Series-O | Series | In Phase | 0 | 0 | 1 | 0 | 1 | 0 | 1 | 0 | 0 | 1 |
| 144 | N | 1 | 1 + 2 Series-O | Series | Out of Phase | 0 | 0 | 1 | 0 | 1 | 0 | 1 | 1 | 0 | 1 |
| 145 | N | 1 | 1 + 2 Parallel-O | Parallel | In Phase | 0 | 0 | 1 | 1 | 0 | 1 | 0 | 0 | 0 | 1 |
| 146 | N | 1 | 1 + 2 Parallel-O | Parallel | Out of Phase | 0 | 0 | 1 | 1 | 0 | 1 | 0 | 1 | 0 | 1 |
| 147 | N | 1 | 1 + 2 Parallel-O | Series | In Phase | 0 | 0 | 1 | 1 | 0 | 1 | 1 | 0 | 0 | 1 |
| 148 | N | 1 | 1 + 2 Parallel-O | Series | Out of Phase | 0 | 0 | 1 | 1 | 0 | 1 | 1 | 1 | 0 | 1 |
| 149 | N | 2 | 1 + 2 Series-O | Parallel | In Phase | 1 | 0 | 0 | 0 | 1 | 0 | 0 | 0 | 0 | 1 |
| 151 | N | 2 | 1 + 2 Series-O | Parallel | Out of Phase | 1 | 0 | 0 | 0 | 1 | 0 | 0 | 1 | 0 | 1 |
| 152 | N | 2 | 1 + 2 Series-O | Series | In Phase | 1 | 0 | 0 | 0 | 1 | 0 | 1 | 0 | 0 | 1 |

TABLE 1-continued

| Coil Combo | Hum Cancel | Neck Pickup | Bridge Pickup | N + B Series/Parallel | N + B Phase | 1 1 | 2 2 | 3 4 | 4 8 | 5 16 | 6 32 | 7 64 | 8 128 | 9 | 10 |
|---|---|---|---|---|---|---|---|---|---|---|---|---|---|---|---|
| 153 | N | 2 | 1 + 2 Series-O | Series | Out of Phase | 1 | 0 | 0 | 0 | 1 | 0 | 1 | 1 | 0 | 1 |
| 154 | N | 2 | 1 + 2 Parallel-O | Parallel | In Phase | 1 | 0 | 0 | 1 | 0 | 1 | 0 | 0 | 0 | 1 |
| 155 | N | 2 | 1 + 2 Parallel-O | Parallel | Out of Phase | 1 | 0 | 0 | 1 | 0 | 1 | 0 | 1 | 0 | 1 |
| 156 | N | 2 | 1 + 2 Parallel-O | Series | In Phase | 1 | 0 | 0 | 1 | 0 | 1 | 1 | 0 | 0 | 1 |
| 157 | N | 2 | 1 + 2 Parallel-O | Series | Out of Phase | 1 | 0 | 0 | 1 | 0 | 1 | 0 | 1 | 0 | 1 |

Table 1 is for a four-coil guitar, such as the guitar which has been described above in conjunction with FIGS. 1-10. All 158 tonalities can be achieved with this system, as indicated by Table 1 above. For instruments with five coils, the fifth coil may be added to any one of the above 158 combinations, either in or out of phase, bringing the total number of tonalities to 158×3=474 tonalities which can be achieved with this system.

For a six-coil instrument, the two additional coils also may be added to any of the 158 table combinations in one of the following six configurations:

1. Coil 5 alone
2. Coil 6 alone
3. Coil 5 in series with Coil 6 in-phase
4. Coil 5 in series with Coil 6 out-of-phase
5. Coil 5 in parallel with Coil 6 in-phase
6. Coil 5 in parallel with Coil 6 out-of-phase This brings the total number of possible tonalities for a six coil instrument to 158×7=1,106 tonalities which can be achieved with the system.

Figure 11:
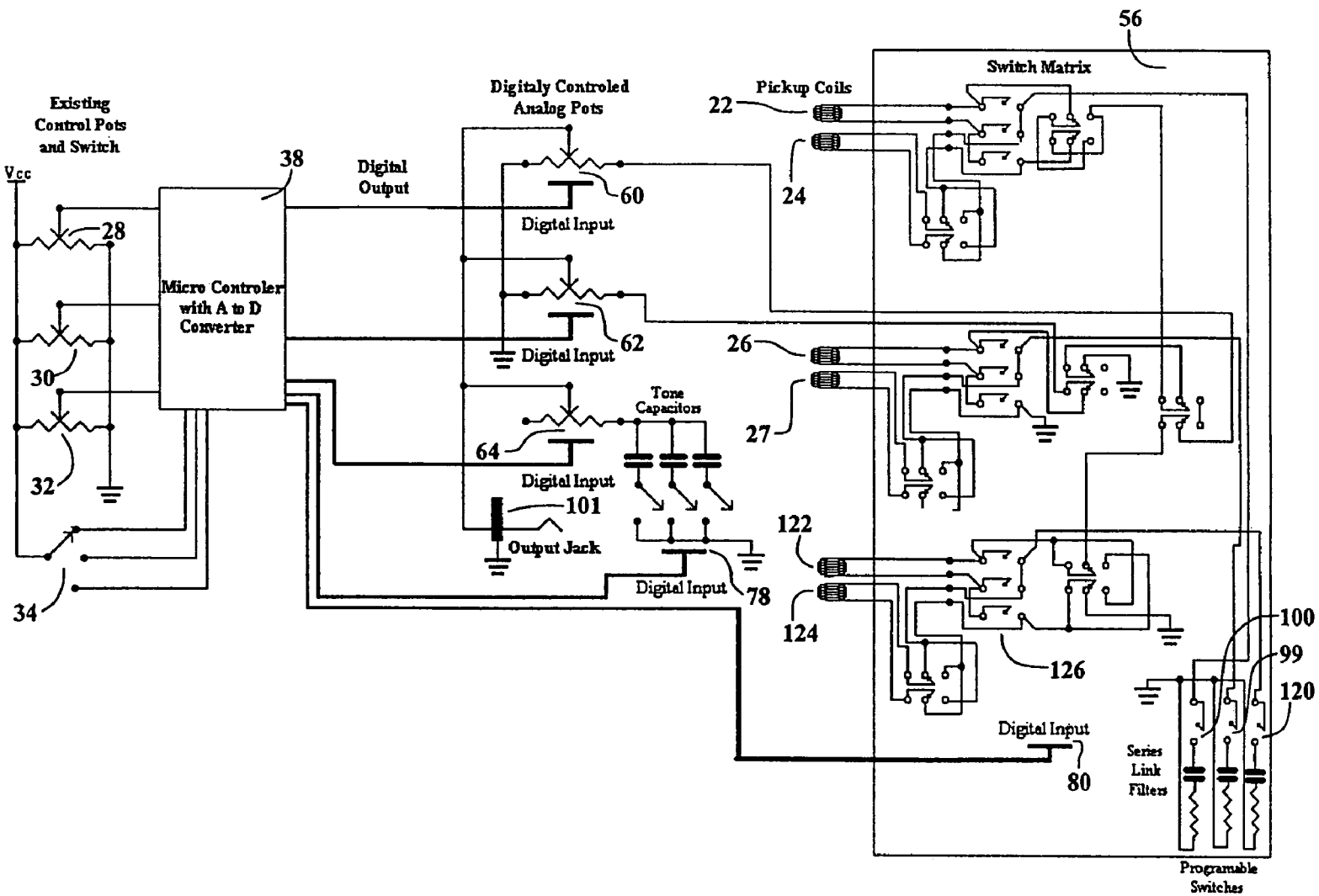
FIG. 11 is an alternative embodiment of the one shown in FIG. 5.

FIG. 11 is similar to FIG. 5, but illustrates the operation of the system in a six-coil version, adding a pair of additional bridge coils 122 and 124. The switch set interconnections for making the various combinations of the pairs of coils in each of the pairs 22/24, 26/27 and 122/124 are similar. The manner in which the different combinations are achieved also is similar for the coils 122 and 124, as for the pickup coil sets 22/24 and 26/27 described in conjunction with FIGS. 5,6 and 7. Additional series link filtering also can be obtained by the addition of another switch 120 in the programmable series link switch set described above in conjunction with the switches 99 and 100. The switch set 126 is comparable to the switch sets associated with each of the other pickup coil pairs shown in the switch matrix 56; and no additional discussion is considered necessary, since the manner in which these coils are interconnected within the set 126 and to the other coil sets is merely an extension of the description above for the four-coil version of the system shown in FIG. 5.

As is readily apparent from the foregoing description, the system which has been disclosed in conjunction with the illustrated embodiments is capable of operation with electric guitars or other instrument inputs having a slide switch, toggle switch or pre-selector switch of any of the normal number of outputs, such as three, five, or seven. The system is not limited to the number of selections from the guitar; but a single pickup combination is programmed into and stored into the table memory 52 for each of the selected switch positions on the guitar, such as the three-position switch 34 shown in FIGS. 5 and 11.

As noted above, any of the various combinations shown in Table 1 can be programmed for any one of the switch positions 34 at the discretion of the user, at the time the guitar is initially programmed and at any subsequent time the program is edited or changed. The system is designed to provide the maximum number of pickup combinations from any pickup configuration, with from two to six magnetic pickup coils. The system also may be used to control on board pre-amplifiers, equalizers and optional Piezo-acoustic pickup and MIDI pickups, if the instrument is so equipped. Pickup configurations which the system can control without any additional changes or programming include a guitar with two humbuckers (as shown in FIG. 1), one humbucker and two single coils, two humbuckers and one single coil, three humbuckers, three single coils, one humbucker and one single coil, two single coils, or one humbucker. For an electric bass guitar with anywhere from two to six magnetic pickup coils, the system also provides the capability of operation without any additional changes or programming for a bass guitar with two single coils, two humbuckers, one single coil plus one humbucker, one humbucker, one humbucker plus two single coils, or three humbuckers, or one single coil.

The foregoing description of the embodiments of the invention is to be considered as illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A sound pickup switching system for an electric string instrument having at least two pickup coils thereon and a multi-position selector switch including in combination: a switch matrix having a plurality of selectively operated switches connected to the pickup coils to electrically interconnect the pickup coils in different predetermined combinations of series, parallel, in-phase, or out-of-phase; a relay driver coupled with the switch matrix to operate the switches; a table memory coupled with the relay driver to control the operation of the relay driver; user input controls coupled with the table memory for entering and storing groups of user selected switch combinations in the table memory; and a connection between the multi-position selector switch on the string instrument and the table memory for operating the relay driver to further operate predetermined combinations of switches in the switch matrix corresponding to the user selected switch combinations stored in the table memory for different positions of the selector switch on the electric string instrument.

2. The combination according to claim 1 wherein different positions of the multi-position selector switch operate the relay driver through the table memory to operate different predetermined combinations of the switches in the switch matrix.

3. The combination according to claim 2 wherein the switches in the switch matrix comprise mechanical contact switches.

4. The combination according to claim 3 further including series link filters and additional switches operated by predetermined settings in the table memory for coupling the series link filters with the plurality of switches in the switch matrix.

5. The combination according to claim 4 further including adjustable volume controls connected with the switch matrix.

6. The combination according to claim 5 further including adjustable tone control means coupled with the pickup coils and the switch matrix for providing predetermined tone control settings.

7. The combination according to claim 6 wherein the programmable volume and/or tone control means comprise programmable potentiometers.

8. The combination according to claim 7 further including programmable tone filters coupled with the pickup coils, the switch matrix, and the table memory.

9. The combination according to claim 1 further including adjustable volume controls connected with the switch matrix.

10. The combination according to claim 9 further including adjustable tone control means coupled with the pickup coils and the switch matrix for providing predetermined tone control settings.

11. The combination according to claim 10 wherein the programmable volume and/or tone control means comprise programmable potentiometers.

12. The combination according to claim 1 further including programmable tone filters coupled with the pickup coils, the switch matrix, and the table memory.

13. The combination according to claim 12 further including series link filters and additional switches operated by predetermined settings in the table memory for coupling the series link filters with the plurality of switches in the switch matrix.

14. The combination according to claim 1 wherein the switches in the switch matrix comprise mechanical contact switches.

15. The combination according to claim 14 further including adjustable volume controls connected with the switch matrix.

16. The combination according to claim 15 further including adjustable tone control means coupled with the pickup coils and the switch matrix for providing predetermined tone control settings.

17. The combination according to claim 16 wherein the programmable volume and/or tone control means comprise programmable potentiometers.

18. The combination according to claim 14 further including programmable tone filters coupled with the pickup coils, the switch matrix, and the table memory.

* * * * *